US007846554B2

(12) United States Patent
Tomes, Jr. et al.

(10) Patent No.: US 7,846,554 B2
(45) Date of Patent: Dec. 7, 2010

(54) FUNCTIONALLY GRADED METAL MATRIX COMPOSITE SHEET

(75) Inventors: David A. Tomes, Jr., Sparks, NV (US); Gavin F. Wyatt-Mair, Lafayette, CA (US); David W. Timmons, Reno, NV (US); Ali Unal, Export, PA (US)

(73) Assignee: Alcoa Inc., Piltspurgh, PA (US)

( * ) Notice: Subject to any disclaimer, the term of this patent is extended or adjusted under 35 U.S.C. 154(b) by 236 days.

(21) Appl. No.: 11/734,121

(22) Filed: Apr. 11, 2007

(65) Prior Publication Data

US 2008/0254309 A1 Oct. 16, 2008

(51) Int. Cl.
*B22F 7/02* (2006.01)
*B22D 11/00* (2006.01)

(52) U.S. Cl. ..... 428/548; 428/472; 428/457; 428/702; 428/704; 428/694 GR; 428/610; 428/547

(58) Field of Classification Search ..... None
See application file for complete search history.

(56) References Cited

U.S. PATENT DOCUMENTS

| | | | |
|---|---|---|---|
| 2,693,012 | A | 11/1954 | Harris et al. |
| 4,235,646 | A | 11/1980 | Neufeld et al. |
| 4,260,419 | A | 4/1981 | Robertson |
| 4,282,044 | A | 8/1981 | Robertson et al. |
| 4,330,027 | A | 5/1982 | Narasimhan |
| 4,523,625 | A | 6/1985 | Ast |
| 4,614,220 | A | 9/1986 | Savage |
| 4,691,758 | A | 9/1987 | Palmer |
| 4,996,025 | A | 2/1991 | Pratt et al. |

(Continued)

FOREIGN PATENT DOCUMENTS

DE 019605398 A1 8/1997

(Continued)

OTHER PUBLICATIONS

Karnezis, P.A. et al, "Characterization of Reinforcement Distribution in Cast Al-Alloy/SiCp Composites" Materials Characterization, 40(2), pp. 97-109, 1998.

(Continued)

*Primary Examiner*—Jennifer C McNeil
*Assistant Examiner*—Vera Katz
(74) *Attorney, Agent, or Firm*—Greenberg Traurig, LLP

(57) ABSTRACT

The present invention discloses a method of making a functionally graded metal matrix composite (MMC) sheet having a central layer of particulate matter. The method includes providing a molten metal containing particulate matter to a pair of advancing casting surfaces. Solidifying the molten metal while advancing the molten metal between the advancing casting surfaces to form a product comprising a first solid outer layer, a second solid outer layer, and a semi-solid central layer having a higher concentration of particulate matter than either of the outer layers. Solidifying the central layer to form a solid metal product comprised of an inner layer sandwiched between the outer layers and withdrawing the metal product from between the casting surfaces. The method yields an MMC having a central layer enriched with particulate matter and sandwiched between metallic outer layers. The product combines the easy mechanical working characteristics and the appearance of the metallic outer layers with the enhanced properties provided by the central MMC layer.

(Continued)

7 Claims, 5 Drawing Sheets

U.S. PATENT DOCUMENTS

| | | | | |
|---|---|---|---|---|
| 5,015,766 | A | 5/1991 | Kambara et al. | |
| 5,053,286 | A | 10/1991 | Pratt et al. | |
| 5,333,672 | A | 8/1994 | Gelfgat et al. | |
| 5,362,523 | A * | 11/1994 | Gorynin et al. | 427/446 |
| 5,365,664 | A | 11/1994 | Whitney, Jr. | |
| 5,400,851 | A | 3/1995 | Prinz et al. | |
| 5,514,228 | A | 5/1996 | Wyatt-Mair et al. | |
| 5,515,908 | A | 5/1996 | Harrington | |
| 5,536,587 | A | 7/1996 | Whitney, Jr. | |
| 5,585,067 | A | 12/1996 | Leroy et al. | |
| 5,588,478 | A | 12/1996 | Jin et al. | |
| 5,742,993 | A | 4/1998 | Sun | |
| 5,862,582 | A | 1/1999 | Sun | |
| 5,894,879 | A | 4/1999 | Wyatt-Mair et al. | |
| 5,942,057 | A | 8/1999 | Hanamura et al. | |
| 6,044,896 | A | 4/2000 | Harrington | |
| 6,063,215 | A | 5/2000 | Harrington | |
| 6,082,659 | A | 7/2000 | Sankaran et al. | |
| 6,102,102 | A | 8/2000 | Harrington | |
| 6,110,604 | A * | 8/2000 | Rickerby | 428/623 |
| 6,135,199 | A | 10/2000 | Wyatt-Mair | |
| 6,221,515 | B1 | 4/2001 | Ramos Junior et al. | |
| 6,273,970 | B1 | 8/2001 | Kopeliovich et al. | |
| 6,316,061 | B1 | 11/2001 | Andler et al. | |
| 6,328,823 | B1 | 12/2001 | Deicke et al. | |
| 6,391,127 | B1 | 5/2002 | Wyatt-Mair et al. | |
| 6,543,122 | B1 | 4/2003 | Perkins et al. | |
| 6,581,675 | B1 | 6/2003 | Harrington | |
| 6,596,671 | B2 | 7/2003 | Whitney, Jr. et al. | |
| 6,623,797 | B2 | 9/2003 | Avalos | |
| 6,672,368 | B2 | 1/2004 | Unal | |
| 6,681,838 | B2 | 1/2004 | Cui et al. | |
| 6,833,339 | B2 | 12/2004 | Whitney, Jr. et al. | |
| 6,880,617 | B2 | 4/2005 | Wyatt-Mair et al. | |
| 2002/0031658 | A1 * | 3/2002 | Chow et al. | 428/323 |
| 2002/0153123 | A1 | 10/2002 | Unal | |
| 2002/0167005 | A1 * | 11/2002 | Yu et al. | 257/43 |
| 2003/0015309 | A1 | 1/2003 | Bouchard et al. | |

FOREIGN PATENT DOCUMENTS

| | | |
|---|---|---|
| EP | 0291505 | 10/1992 |
| EP | 0668936 | 5/1994 |
| WO | WO-9100933 | 1/1991 |
| WO | 2004018124 | 3/2004 |

OTHER PUBLICATIONS

Pan, Fusheng et al, "SiC Particulate Distribution in the AS-Cast Strips of SiCp/A356 Aluminum Matrix Composites" Acta Materiae Compositae Sinica, China, vol. 12, No. 1, Feb. 1995, pp. 1-9.

Griffiths, P. et al., "Metal Matrix Composite Sheet Produced by Twin-Roll Casting", Department of Materials University of Oxford Oxford OX13PH UK, pp. 207-212.

Karnezis, P.A. et al., "Mechanical Properties and Microstructure of Twin Roll Cast Al-7Si/SiCp MMCs", Materials Science and Technology Aug. 1995 vol. 11 pp. 741-751.

Karnezis, P.A. et al., "Effect of Processing on the Microstructure and Tensile Properties of A356/SiCp MMCs", Materials Science Forum vols. 217-222 (1996) pp. 341-346, 1996 Transtec Publications, Switzerland.

International Search Report From the Corresponding International Patent Application No. PCT/US2008/060060 Dated Jul. 1, 2008.

Written Opinion of the International Serach Authority From the Corresponding International Patent Application No. PCT/US2008/060060.

E.C. Ellwood. "Tin and its Alloys," pp. 282-295, Edward Arnold (Publishers) Ltd. London, 1960.

J.Z. Zhao, S. Drees, L. Ratke, "Strip Casting of Al-Pb Alloys—a Numerical Analysis," Materials Science and Engineering, vol. A282, pp., circa 2000.

U.S. Office Action against U.S. Appl. No. 11/734,113 dated Jan. 13, 2009.

U.S. Office Action against U.S. Appl. No. 11/734,113 dated Sep. 21, 2009.

U.S. Office Action against U.S. Appl. No. 11/734,113 dated Feb. 18, 2010.

International Search Report and Written Opinion of the International Searching Authority mailed from the European Patent Office on Jul. 4, 2008 for PCT Application No. PCT/US2008/060050.

Supplementary European Search Report for Application No. EP03737080.6 dated Feb. 3, 2006.

European Office Action for Application No. EP03737080.6 dated Jun. 26, 2007.

European Office Action for Application No. EP03737080.6 dated Sep. 25, 2009.

European Office Action for Application No. EP03737080.6 dated Mar. 9, 2010.

European Office Action for Application No. EP03737080.6 dated Mar. 22, 2010.

* cited by examiner

FUNCTIONALLY GRADED MMC STRIP - METALLIC OUTER LAYERS FOR GOOD FORMABILITY, MMC CENTER FOR IMPROVED RIGIDITY (Al-15 VOLUME % $Al_2O_3$ COMPOSITE IN ROLLED CONDITION AT 0.2 mm THICKNESS)

FUNCTIONALLY GRADED METAL MATRIX COMPOSITE SHEET

FIELD OF THE INVENTION

This invention relates to aluminum based Metal Matrix Composites. More particularly, this invention relates to a functionally graded Metal Matrix Composite sheet comprising a central layer having a high density of particulates and a method of making such a sheet. The invention can be practiced in accordance with the apparatus disclosed in commonly owned U.S. Pat. Nos. 5,514,228, 6,672,368 and 6,880,617.

BACKGROUND OF THE INVENTION

Metal Matrix Composites (MMC) combine the properties of a metal matrix with reinforcing particulates thereby enhancing the mechanical properties of the end product. For example, an aluminum based MMC product will typically exhibit an increase in elastic modulus, lower coefficient of thermal expansion, greater resistance to wear, improvement in rupture stress, and in some instances, an increase in resistance to thermal fatigue.

Existing methods of fabricating MMC include squeeze casting, squeeze infiltration, spray deposition, slurry casting, and powder processing. The goal of these fabricating methods is to produce a uniform distribution of particulates throughout a metal matrix or to distribute the particulates near the outer surfaces of the metal product. For example, U.S. Pat. No. 4,330,027 describes a method of embedding particulate matter on the outer surface of a metal strip by forming a solidification front that pushes the particulate matter to the surface of the strip. In the past, however, fabrication of cast MMC into a finished product by rolling, forging, or extrusion has been impeded by the high loading characteristics of the particulate phase.

A need exists, therefore, for an aluminum based Metal Matrix Composite that combines the enhanced mechanical properties of MMC with improved ductility, appearance, and ease of fabrication. The present invention responds to this need by providing a functionally graded MMC with enhanced characteristics, comprising a central layer having a high density of particulates sandwiched between two outer metallic layers, and a method of manufacturing such a sheet.

SUMMARY OF THE INVENTION

The present invention discloses a method of making a functionally graded MMC sheet having a central layer of particulate matter. The method includes providing molten metal containing particulate matter to a pair of advancing casting surfaces. The molten metal is then solidified while being advanced between the advancing casting surfaces to form a composite comprising a first solid outer layer, a second solid outer layer, and a semi-solid central layer having a higher concentration of particulate matter than either of the outer layers.

The central layer is then solidified to form a solid composite metal product comprised of an inner layer sandwiched between the two outer layers and the metal product is withdrawn from between the casting surfaces. After withdrawing the product from between the casting surfaces, the product can then be subjected to one or more hot rolling or cold rolling passes.

The casting surfaces are typically the surfaces of a roll or a belt with a nip defined therebetween. Preferably, the metal product exits the nip at a speed ranging from about 50-300 fpm. In practice, the molten metal can be an aluminum alloy and the particulate matter can be an aluminum oxide for example. As described earlier, the metal product resulting from the method of the present invention comprises two outer layers and an inner layer with a high concentration of particulate matter. For example, for an aluminum based MMC, the inner layer could be comprised of approximately 70% aluminum oxide particles by volume. The product of the present invention can be a strip, a sheet, or a panel having a thickness ranging from about 0.004 inches to about 0.25 inches and is a metal matrix composite that combines the advantages of an MMC with enhancements in ductility, appearance, and ease of fabrication.

The product of the present invention is suitable for use in structural applications such as panels used in the aerospace, automotive, and building and construction industries.

DETAILED DESCRIPTION OF PREFERRED EMBODIMENTS

Figure 1:
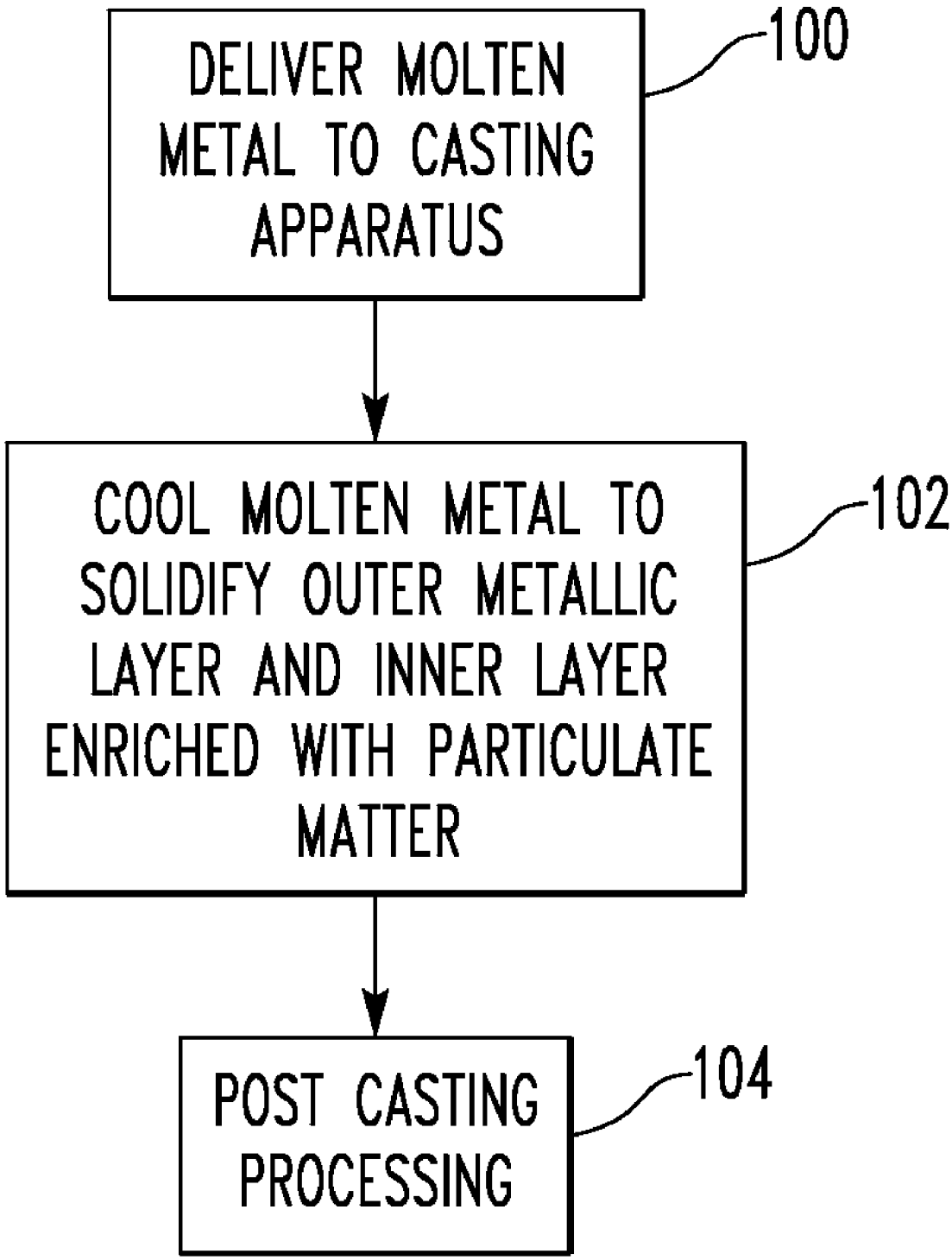
FIG. 1 is a flow-chart describing the method of the present invention.

The accompanying drawings and the description which follows set forth this invention in its preferred embodiments. It is contemplated, however, that persons generally familiar with casting processes will be able to apply the novel characteristics of the structures and methods illustrated and described herein in other contexts by modification of certain details. Accordingly, the drawings and description are not to be taken as restrictive on the scope of this invention, but are to be understood as broad and general teachings. When referring to any numerical range of values, such ranges are understood to include each and every number and/or fraction between the stated range minimum and maximum.

Finally, for purposes of the description hereinafter, the terms "upper", "lower", "right", "left", "vertical", "horizontal", "top", "bottom", and derivatives thereof shall relate to the invention, as it is oriented in the drawing figures.

The phrases "aluminum alloys", "magnesium alloys" and "titanium alloys" are intended to mean alloys containing at least 50% by weight of the stated element and at least one modifier element. Aluminum, magnesium, and titanium alloys are considered attractive candidates for structural use in aerospace and automotive industries because of their light weight, high strength to weight ratio, and high specific stiffness at both room and elevated temperatures. The present invention can be practiced with all Aluminum Alloys The invention in its most basic form is depicted schematically in the flow chart of FIG. 1. As is depicted therein, in step 100, molten metal containing particulate matter is delivered to a casting apparatus. The casting apparatus includes a pair of spaced apart advancing casting surfaces as described in detail below. In step 102, the casting apparatus rapidly cools at least a portion of the molten metal to solidify an outer layer of the molten metal and inner layer enriched with particulate matter. The solidified outer layer increases in thickness as the alloy is cast.

The product exiting the casting apparatus includes the solid inner layer formed in step 102 containing the particulate matter sandwiched within the outer solid layers of the molten metal. The product can be generated in various forms such as but not limited to a sheet, a plate, a slab, or a foil. In extrusion casting, the product may be in the form of a wire, rod, bar or other extrusion. In either case, the product may be further processed and/or treated in step 104. It should be noted that the order of steps 100-104 are not fixed in the method of the present invention and may occur sequentially or some of the steps may occur simultaneously.

In the present invention, the rate at which the molten metal is cooled is selected to achieve rapid solidification of the outer layers of the metal. For aluminum alloys and other metallic alloys, cooling of the outer layers of metal may occur at a rate of at least about 1000 degrees centigrade per second. Suitable casting apparatuses that may be used with the disclosed invention include, but shall not be limited to cooled casting surfaces such as can be found in a twin roll caster, a belt caster, a slab caster, or a block caster. Vertical roll casters may also be used in the present invention. In a continuous caster, the casting surfaces are generally spaced apart and have a region at which the distance therebetween is at a minimum.

In a roll caster, the region of minimum distance between casting surfaces is known as a nip. In a belt caster, the region of minimum distance between casting surfaces of the belts may be a nip between the entrance pulleys of the caster. As is described in more detail below, operation of a casting apparatus in the regime of the present invention involves solidification of the metal at the location of minimum distance between the casting surfaces. While the method of present invention is described below as being performed using a twin roll caster, this is not meant to be limiting. Other continuous casting surfaces may be used to practice the invention.

Figure 2:
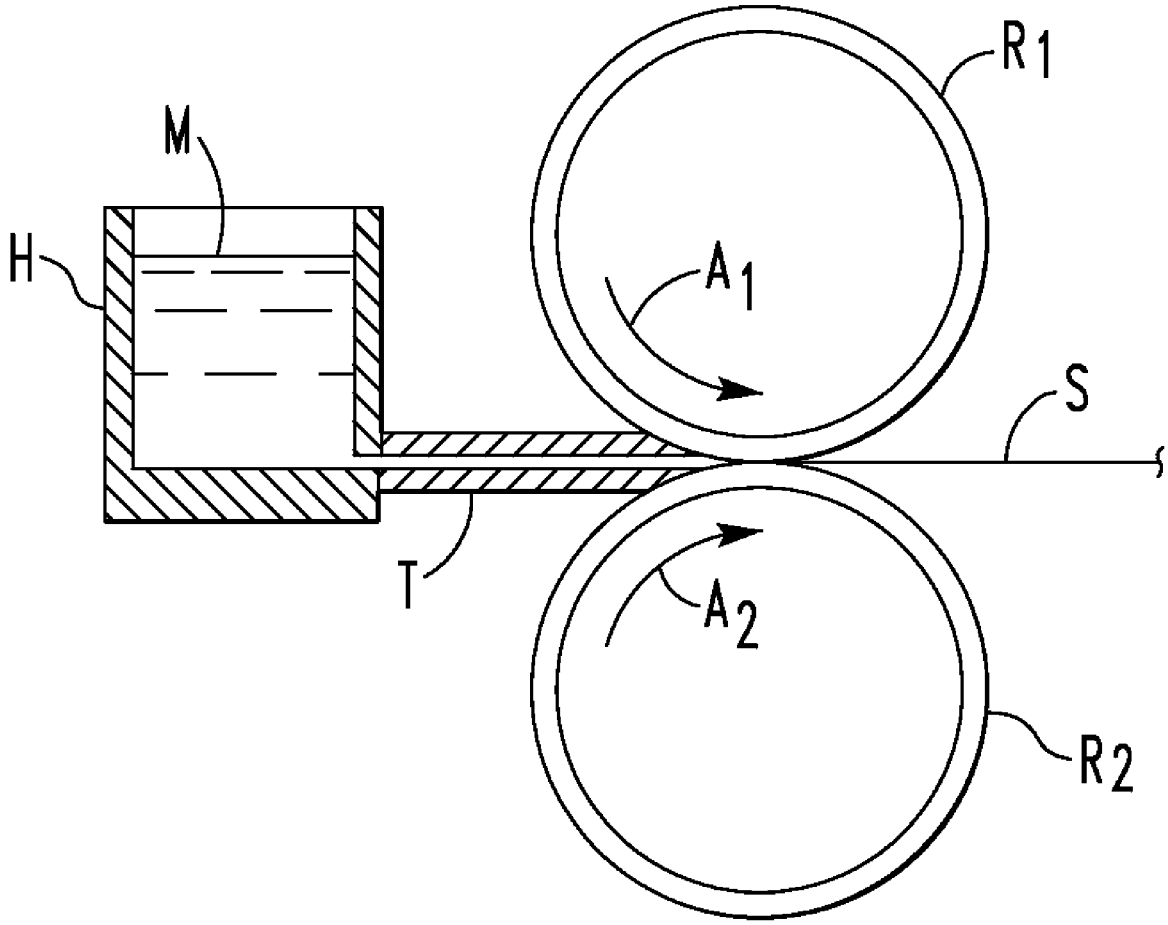
FIG. 2 is a schematic depicting a type of apparatus used in the method of the present invention.
Figure 3:
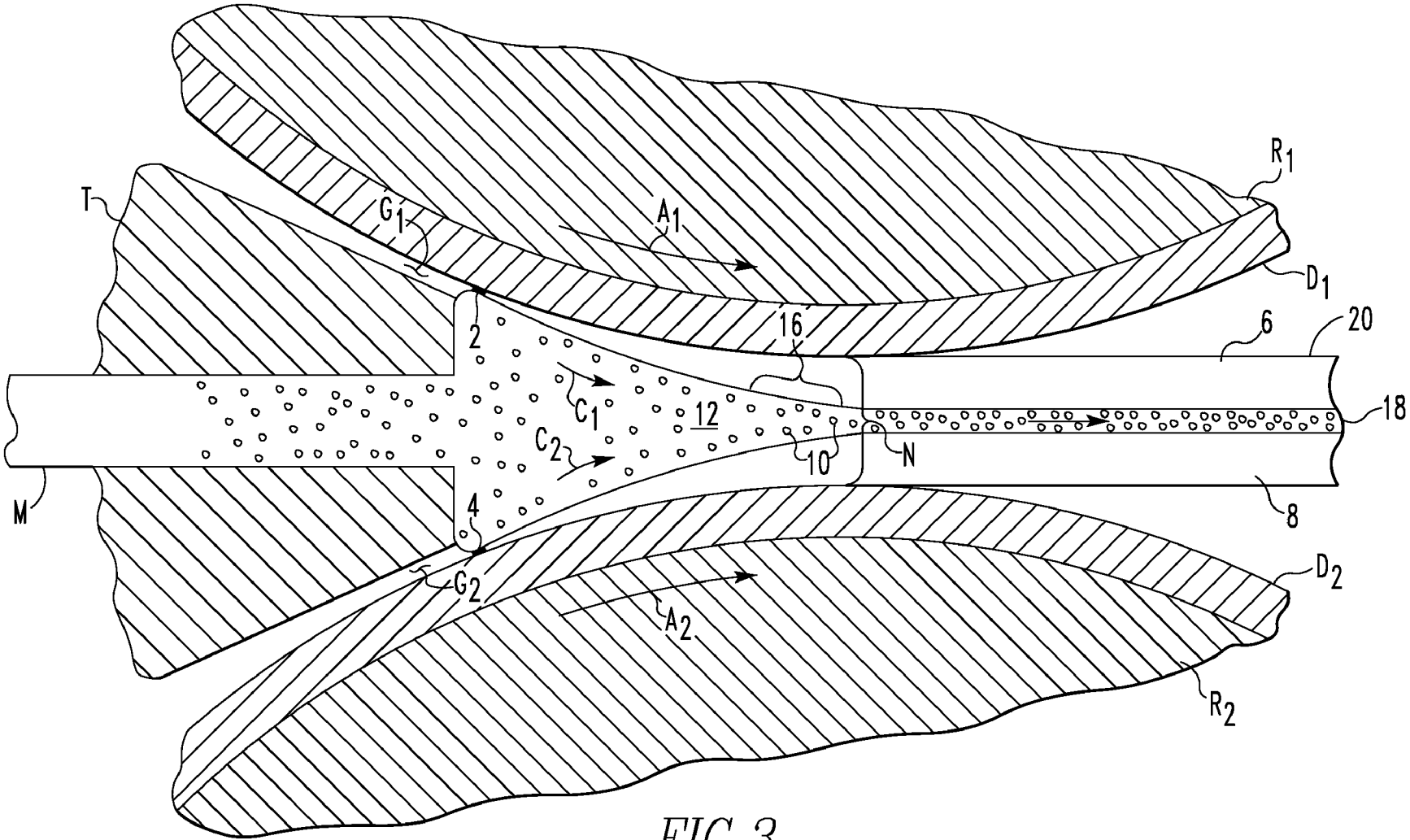
FIG. 3 is an enlarged cross-sectional schematic detailing apparatus operated in accordance with the present invention.

By way of example, a roll caster (FIG. 2) may be operated to practice the present invention as shown in detail in FIG. 3. Referring now to FIG. 2 (which generically depicts horizontal continuous casting according to the prior art and according to the present invention), the present invention can be practiced using a pair of counter-rotating cooled rolls $R_1$ and $R_2$ rotating in the directions of the arrows $A_1$ and $A_2$, respectively. A Roll Caster in conventional use operates at slow speeds and does not produce a functionally graded product. As shown in more detail in FIG. 3, in the practice of the present invention, a feed tip T, which may be made from a refractory or other ceramic material, distributes molten metal M in the direction of arrow B directly onto the rolls $R_1$ and $R_2$ rotating in the direction of the arrows $A_1$ and $A_2$, respectively. Gaps $G_1$ and $G_2$ between the feed tip T and the respective rolls $R_1$ and $R_2$ are maintained as small as possible to prevent molten metal from leaking out and to minimize the exposure of the molten metal to the atmosphere along the rolls $R_1$ and $R_2$ while avoiding contact between the tip T and the rolls $R_1$ and $R_2$. A suitable dimension of the gaps $G_1$ and $G_2$ is about 0.01 inch. A plane L through the centerline of the rolls $R_1$ and $R_2$ passes through a region of minimum clearance between the rolls $R_1$ and $R_2$ referred to as the roll nip N.

As can be seen from FIG. 3, in this invention molten metal M containing particulate matter 10 is provided between rolls $R_1$ and $R_2$ of the roll caster. One skilled in the art would understand that the rolls $R_1$ and $R_2$ are the casting surfaces of the roll caster. Typically, $R_1$ and $R_2$ are cooled to aid in the solidification of the molten metal M, which directly contacts the rolls $R_1$ and $R_2$ at regions 2 and 4, respectively. Upon contact with the rolls $R_1$ and $R_2$, the metal M begins to cool and solidify. The cooling metal solidifies as a first shell 6 of solidified metal adjacent the roll $R_1$ and a second shell 8 of solidified metal adjacent to the roll $R_2$.

The thickness of each of the shells 8 and 6 increases as the metal M advances towards the nip N. Initially, the particulate matter 10 is located at the interfaces between each of the first and second shells 8 and 6 and the molten metal M. As the molten metal M travels between the opposing surfaces of the cooled rolls $R_1$, $R_2$, the particulate matter 10 is dragged into a center portion 12 of the slower moving flow of the molten metal M and is carried in the direction of arrows $C_1$ and $C_2$. In the central portion 12 upstream of the nip N referred to as region 16, the metal M is semi-solid and includes a particulate matter 10 component and a molten metal M component. The molten metal M in the region 16 has a mushy consistency due in part to the dispersion of the particulate matter 10 therein.

The forward rotation of the rolls $R_1$ and $R_2$ at the nip N advances substantially only the solid portion of the metal, i.e. the first and second shells 6 and 8 and the particulate matter in the central portion 12 while forcing molten metal M in the central portion 12 upstream from the nip N such that the metal is substantially solid as it leaves the point of the nip N. Downstream of the nip N, the central portion 12 is a solid central layer 18 containing particulate matter 10 sandwiched between the first shell 6 and the second shell 8.

Figure 4:
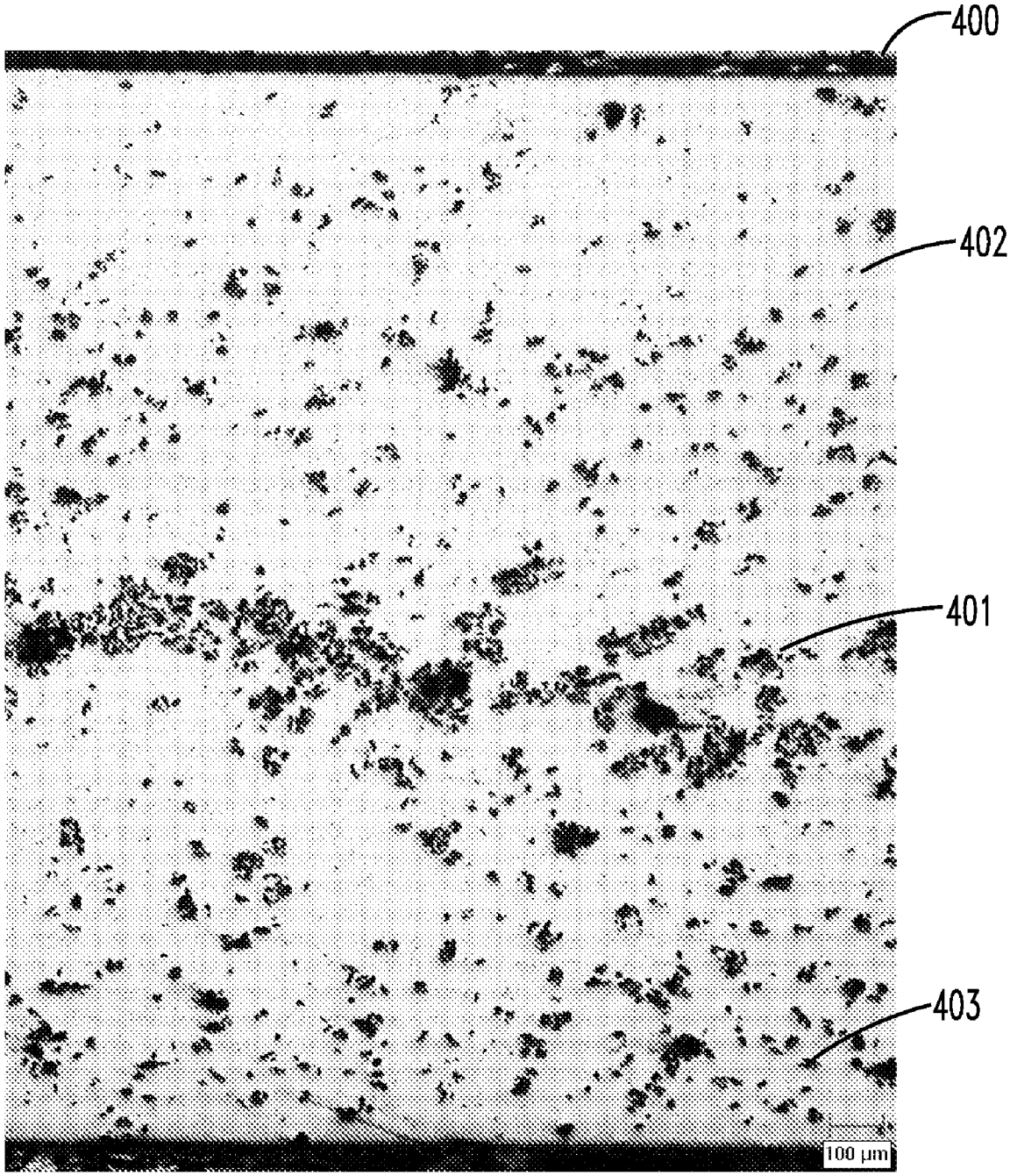
FIG. 4 is a photomicrograph of a transverse section of a strip produced in accordance with the present invention.

For clarity, the three layered aluminum article described above having a central layer 18 with a high concentration of particulate matter 10 sandwiched between the first and second shells 6 and 8 shall also be referred to as a functionally graded MMC structure. The size of the particulate matter 10 in the central layer 18 is at least about 30 microns. In a strip product, the solid inner portion may constitute about 20 to about 30 percent of the total thickness of the strip. While the caster of FIG. 4 is shown as producing strip S in a generally horizontal orientation, this is not meant to be limiting as the strip S may exit the caster at an angle or vertically.

The casting process described in relation to FIG. 3 follows the method steps outlined above in FIG. 1. Molten metal delivered in step 100 to the roll caster begins to cool and solidify in step 102. The cooling metal develops outer layers of solidified metal, i.e. first and second shells 6 and 10, near or adjacent the cooled casting surfaces $R_1$, $R_2$. As stated in the preceding paragraphs, the thickness of the first shell 6 and the second shell 8 increases as the metal advances through the casting apparatus. Per step 102, the particulate matter 10 is drawn into the central portion 12, which is partially surrounded by the solidified outer layers 6 and 8. In FIG. 3, the first and second shells 6 and 8 substantially surround the central layer 18.

In other words, the central layer 18 that contains the particulate matter 10 is located between the first shell 6 and the second shell 8. Said differently, the central layer 18 is sandwiched between the first shell 6 and the second shell 8. In other casting apparatuses, the first and/or second shells may completely surround the inner layer. Referring to FIG. 1, in step 104, the inner layer is solidified. Prior to complete solidification of the metal, the inner layer of the metal is semi-solid and includes a particulate matter component and a molten metal component. The metal at this stage has a mushy consistency due in part to the dispersion of particulate matter therein.

In step 106, the product is completely solidified and includes an inner layer that contains surrounds the inner layer. The thickness of the inner portion may be about 10-40% of the thickness of the product. In a preferred embodiment, the inner portion is comprised of about 70% particulate matter 10 by volume, while the first and second shells are comprised of about 10% particulate matter 10 by volume. Accordingly, the highest concentration of MMC are in the inner portion, while the outer shells have a low concentration of MMC.

Movement of the particulate matter 10 having a size of at least about 30 microns into the inner layer in step 104 is caused by the shear forces that result from the speed differences between the inner layer of molten metal and the solidified outer layers. In order to achieve this movement into the inner layer, the roll casters would need to be be operated at speeds of at least about 50 feet per minute. Roll casters operated at conventional speeds of less than 10 feet per minute do not generate the shear forces required to move the particulate matter having a size of about 30 microns or greater into the inner layer.

An important aspect of the present invention is the movement of particulate matter having a size of at least about 30 microns into the inner layer.

The fuctionally graded MMC structure disclosed in this invention combines the benefits of a MMC (e.g. improved mechanical properties) with the ductility and appearance of metallic outer layers. The casting surfaces used in the practice of the invention serve as heat sinks for the heat of the molten metal M. in operation, heat is transferred from the molten metal to the cooled casting surface in a uniform manner to ensure uniformity in the surface of the cast product. The cooled casting surfaces may be made from steel or copper and may be textured to include surface irregularities which contact the molten metal. The casting surfaces can also be coated by another metal such as nickel or chrome for example or a non-metal.

The surface irregularities may serve to increase the heat transfer from the surfaces of the cooled casting surfaces. Imposition of a controlled degree of non-uniformity in the surfaces of the cooled casting surfaces results in more uniform heat transfer across the surfaces thereof. The surface irregularities may be in the form of grooves, dimples, knurls or other structures and may be spaced apart in a regular pattern. In a roll caster operated in the regime of the present invention, the control, maintenance and selection of the appropriate speed of the rolls $R_1$ and $R_2$ may impact the operability of the present invention. The roll speed determines the speed that the molten metal M advances towards the nip N. If the speed is too slow, the particulate matter 10 will not experience sufficient forces to become entrained in the central portion 12 of the metal product. Accordingly, the present invention is suited for operation at speeds greater than 50 feet per minute.

In the preferred embodiment, the present invention is operated at speeds ranging from 50-300 fpm. The linear speed that molten aluminum is delivered to the rolls $R_1$ and $R_2$ may be less than the speed of the rolls $R_1$ and $R_2$ or about one quarter of the roll speed. High-speed continuous casting according to the present invention is achievable in part because the textured surfaces $D_1$ and $D_2$ ensure uniform heat transfer from the molten metal M and as is discussed below, the roll separating force is another important parameter in practicing the present invention.

A significant benefit of the present invention is that solid strip is not produced until the metal reaches the nip N. The thickness is determined by the dimension of the nip N between the rolls $R_1$ and $R_2$. The roll separating force is sufficiently great to squeeze molten metal upstream and away from the nip N. Were this not the case, excessive molten metal passing through the nip N would cause the layers of the upper and lower shells 6 and 8 and the solid central layer 18 to fall away from each other and become misaligned. Conversely, insufficient molten metal reaching the nip N causes the strip to form prematurely as occurs in conventional roll casting processes. A prematurely formed strip 20 may be deformed by the rolls $R_1$ and $R_2$ and experience centerline segregation.

Suitable roll separating forces range from about 5-1000 lbs per inch of width cast. In general, slower casting speeds may be needed when casting thicker gauge alloys in order to remove the heat from the thick alloy. Unlike conventional roll casting, such slower casting speeds do not result in excessive roll separating forces in the present invention because fully solid non-ferrous strip is not produced upstream of the nip. Alloy strip may be produced at thicknesses of about 0.08 inches to 0.25 inches at casting speeds ranging from 50-300 fpm.

In the preferred embodiment, the molten metal is aluminum or an aluminum alloy. In a second embodiment, the particulate matter can be any non-metallic material such as Aluminum Oxide, Boron Carbide, silicon Carbide and Boron Nitride or a metallic material created in-situ during casting or added to the molten metal.

Figure 5:
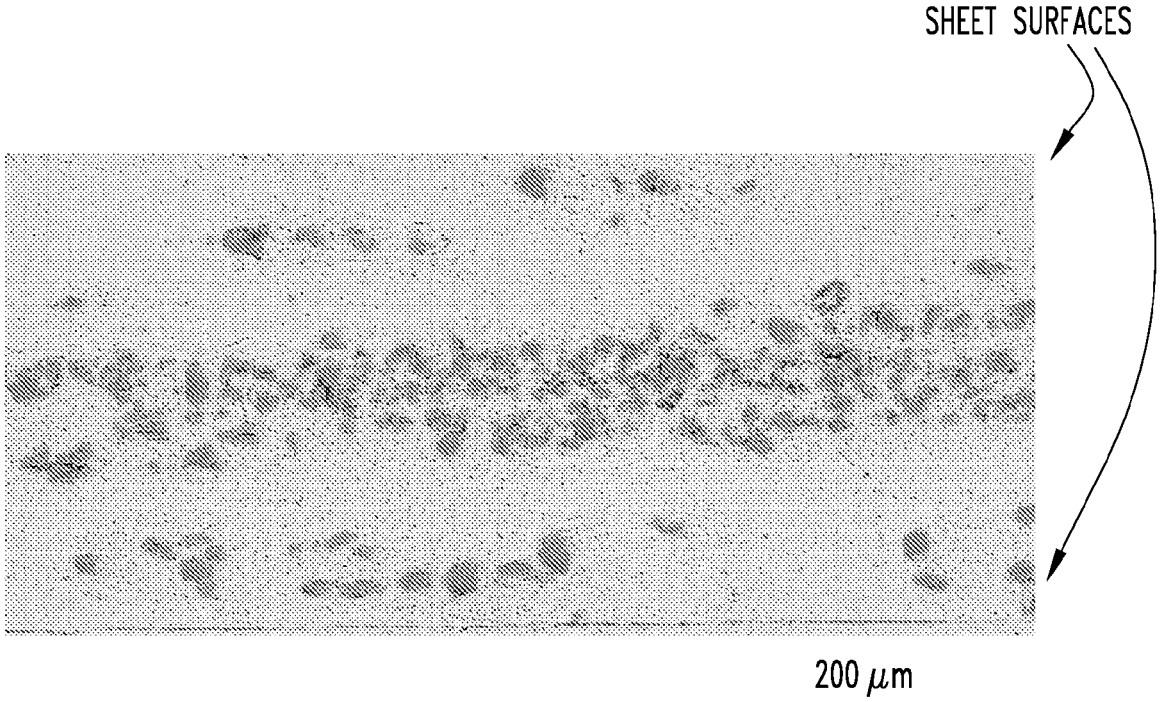
FIG. 5 is a photomicrograph of the transverse section of a strip produced in accordance with the present invention and then hot rolled to a thickness of 0.008 inch thickness

Referring now to FIG. 4, depicted therein is a microstructure of a functionally graded MMC cast in accordance with the present invention. The strip 400 shown comprises 15% alumina by weight and is at 0.004 gauge. The particulate matter 10 can be seen distributed throughout the strip 400 with a higher concentration of particulates concentrated in a central layer 401 while lower concentrations can be seen in outer layers 402 and 403 respectively. It should be noted that there is no reaction between the particulate matter and the aluminum matrix due to the rapid solidification of the molten during the process of the present invention. Moreover, in a rolled product in accordance with the present invention there is no damage at the interface between the particulate and the metal matrix as may be seen in FIG. 5. The present invention also allows the production of a cold rolled product without any need to reheat during the cold rolling process. Because the particulate matter does not protrude above the surface of the product it does not wear or abrade the rolling mill rolls.

Having described the presently preferred embodiments, it is to be understood that the invention may be otherwise embodied within the scope of the appended claims.

What is claimed is:

1. An aluminum alloy product consisting essentially of:

a first outer shell;

an inner portion; and a second outer shell;

wherein particulate matter is distributed across the first outer shell, the inner portion, and the second outer shell in a concentration gradient;

wherein the inner portion has a higher concentration of particulate matter than the first outer shell and the second outer shell;

wherein the particulate matter is selected from the group consisting of aluminum oxide, boron carbide, silicon carbide, boron nitride and any non-metallic material;

wherein the particulate matter has a size of at least about 30 microns;

wherein the aluminum alloy product has a thickness ranging from between about 0.004 inches to about 0.25 inches; and wherein the aluminum alloy product is selected from the group consisting of a single-cast aluminum alloy strip, a single-cast aluminum alloy sheet, a single-cast aluminum alloy panel, a single-cast aluminum alloy slab, a single-cast aluminum alloy foil, a single-cast aluminum alloy wire, a single-cast aluminum alloy rod, and a single-cast aluminum alloy bar.

2. The aluminum alloy product according to claim 1 wherein the volume of the inner portion is comprised of up to about 70% aluminum oxide particles.

3. The aluminum alloy product according to claim 1 wherein the aluminum alloy product is fabricated using a roll casting process.

4. The aluminum alloy product according to claim 1 wherein the aluminum alloy product has a thickness ranging from about 0.08 inches to about 0.25 inches.

5. The aluminum alloy product of claim 1, wherein about 70%, by volume, of the particulate matter is in the inner portion, about 10%, by volume, of the particulate matter is in the first outer shell, and about 10%, by volume, of the particulate matter is in the second outer shell.

6. An aluminum alloy product consisting essentially of:

a first shell;

a second shell; and a central layer disposed between the first shell and the second shell;

wherein particulate matter is distributed across the first shell, the central layer, and the second shell in a concentration gradient;

wherein the central layer has a higher concentration of particulate matter than the first shell and the second shell;

wherein the particulate matter is selected from the group consisting of aluminum oxide, boron carbide, silicon carbide, boron nitride and any non-metallic material;

wherein the particulate matter has a size of at least about 30 microns;

wherein the aluminum alloy product has a thickness ranging from between about 0.004 inches to about 0.25 inches; and wherein the aluminum alloy product is selected from the group consisting of a single-cast aluminum alloy strip, a single-cast aluminum alloy sheet, a single-cast aluminum alloy panel, a single-cast aluminum alloy slab, a single-cast aluminum alloy foil, a single-cast aluminum alloy wire, a single-cast aluminum alloy rod, and a single-cast aluminum alloy bar.

7. An aluminum alloy product consisting essentially of:

a first outer shell;

an inner portion; and a second outer shell;

wherein particulate matter is distributed across the first outer shell, the inner portion, and the second outer shell in a concentration gradient;

wherein the first outer shell, inner portion, and second outer shell are integral;

wherein the inner portion has a higher concentration of particulate matter than the first outer shell and the second outer shell;

wherein the particulate matter is selected from the group consisting of aluminum oxide, boron carbide, silicon carbide, boron nitride and any non-metallic material;

wherein the particulate matter has a size of at least about 30 microns;

wherein the aluminum alloy product has a thickness ranging from between about 0.004 inches to about 0.25 inches; and wherein the aluminum alloy product is selected from the group consisting of a single-east aluminum alloy strip, a single-cast aluminum alloy sheet, a single-cast aluminum alloy panel, a single-cast aluminum alloy slab, a single-cast aluminum alloy foil, a single-cast aluminum alloy wire, a single-cast aluminum alloy rod, and a single-cast aluminum alloy bar.

* * * * *